United States Patent [19]

Mellen, Sr.

[11] Patent Number: 4,931,624

[45] Date of Patent: Jun. 5, 1990

[54] THERMAL DISTORTION FREE VIEWING OF A HEATED CAVITY

[76] Inventor: Robert H. Mellen, Sr., P.O. Box 535, New London, N.H. 03257

[21] Appl. No.: 340,125

[22] Filed: Apr. 17, 1989

Related U.S. Application Data

[62] Division of Ser. No. 71,771, Jul. 10, 1987.

[51] Int. Cl.[5] ..... H05B 1/02

[52] U.S. Cl. ..... 219/497; 219/506; 219/494; 219/522; 373/166; 156/601; 422/249; 126/190; 126/200

[58] Field of Search ..... 219/522, 543, 497, 501, 219/506, 494; 126/190, 200; 373/166; 156/601, 620; 422/249, 105, 248

[56] References Cited

U.S. PATENT DOCUMENTS

| | | | |
|---|---|---|---|
| 3,865,554 | 2/1975 | Wenckus et al. | 156/601 |
| 4,210,120 | 7/1980 | Ritopecki | 126/200 |
| 4,318,769 | 3/1982 | Sachs | 156/601 |
| 4,660,149 | 4/1987 | Lissalde et al. | 156/601 |
| 4,707,586 | 11/1987 | Voss et al. | 219/522 |
| 4,794,263 | 12/1988 | Katsuoka et al. | 156/601 |
| 4,822,449 | 4/1989 | Motakef | 156/601 |

FOREIGN PATENT DOCUMENTS

| | | | |
|---|---|---|---|
| 0171694 | 2/1986 | European Pat. Off. | 156/601 |

*Primary Examiner*—M. H. Paschall

*Attorney, Agent, or Firm*—Thomas N. Tarrant

[57] ABSTRACT

High temperature furnaces are described containing a movable viewing window that is heated so that the work charge can be scanned along the length of the furnace without creating a thermal disturbance. A system is also disclosed for controlling the operation of the furnace based on comparison of viewed images with stored sample images.

5 Claims, 4 Drawing Sheets

THERMAL DISTORTION FREE VIEWING OF A HEATED CAVITY

RELATED APPLICATIONS

The present application is a division of patent application Ser. No. 07/071,771 filed July 10, 1987 by the same inventor, now pending.

BACKGROUND OF THE INVENTION

1. Field of the Invention

The invention relates to viewports for high temperature furnaces and in particular to such ports that provide minimum thermal disturbance.

2. Description of the Prior Art

Viewing ports for furnaces and ovens have been common for adjusting flames and for observing work in progress. Open ports and ports covered with heat resistance glass or quartz have been used. It has also been known to use photographic and video cameras to observe explosions and heating action.

Any hole or penetration into a heated cavity produces thermal distortions of the heat flow within. Such distortion can be extremely detrimental in, for example, growing monocrystal material for integrated circuit use. At the same time, observation can be very desirable in order to control temperatures in accordance with the activity. Prior viewports have not overcome this problem.

SUMMARY OF THE INVENTION

In accordance with the present invention, heat is introduced at a viewpoint of a heated cavity in an amount to balance the thermal disturbance produced by the viewport. The viewport is a slot, in a movable thermally insulating block, that narrows transversely to a waist portion at which a refractory window may be located and then widens again. Heating elements on both sides of the slot introduce heat into the slot on the cavity side of the window. An insulated block containing the slot fills the entire aperture through which movement occurs positioning the slot at sequential locations for viewing.

DESCRIPTION OF THE PREFERRED EMBODIMENTS

The present invention is of particular advantage in precision furnaces such as used for growing crystals. A furnace of that type is disclosed in U.S. Letters Patent No. 4,518,351 by the present inventor. The invention will be described in relation to its utilization in such a furnace.

Figure 1:
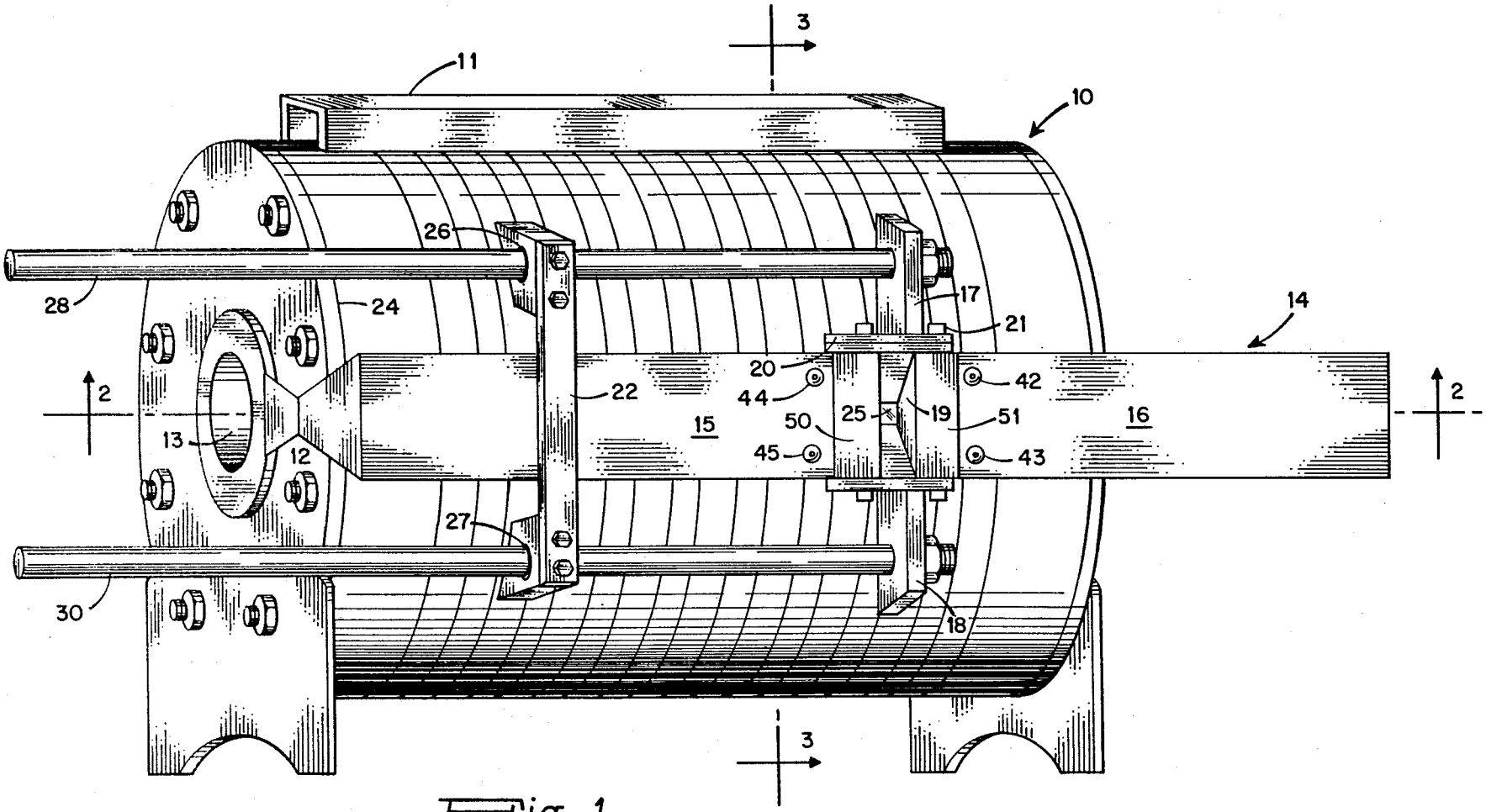
FIG. 1 is a projection, partially diagramatic, of a furnace with the inventive window.

Furnace 10 of FIG. 1 is an electrodynamic gradient furnace. That is, furnace 10 comprises a series of transverse electrical heating elements that are separately controllable so as to provide a movable temperature gradient within heated cavity 13. The leads and control devices have been omitted from the drawing for ease of illustration. Some or all of the leads to the elements may be provided through conduit enclosure 11 mounted on furnace 10. Longitudinal aperture 12 extends the entire length of furnace 10 along its left side for carrying viewport assembly 14. Viewport assembly 14 is suitably made of a block of thermally insulating refractory material such as an aluminum oxide ceramic. While it is possible to cut a slot in the ceramic material, assembly 14 is depicted in two parts 15 and 16. Parts 15 and 16 are supported in spaced relationship by support brackets 17 and 18 so as to provide slot 19.

Support bracket 17 on top of viewport assembly 14 carries bolts 20 and 21 which pass through parts 15 and 16 respectively and are secured through bracket 18. Third support bracket 22 is mounted to the wall of furnace 10, at a position as near front end 24 of furnace 10 as it is desired to operate viewport 25. Bracket 22 spans part 15 in near spaced relationship and has cylindrical guide apertures 26 and 27 above and below part 15. Operating rods 28 and 30 pass through guide apertures 26 and 27 respectively and connect to support brackets 17 and 18 respectively.

Terminals 31 are connecting terminals for electrical power leads to provide heating power to viewport assembly 14.

Figure 2:
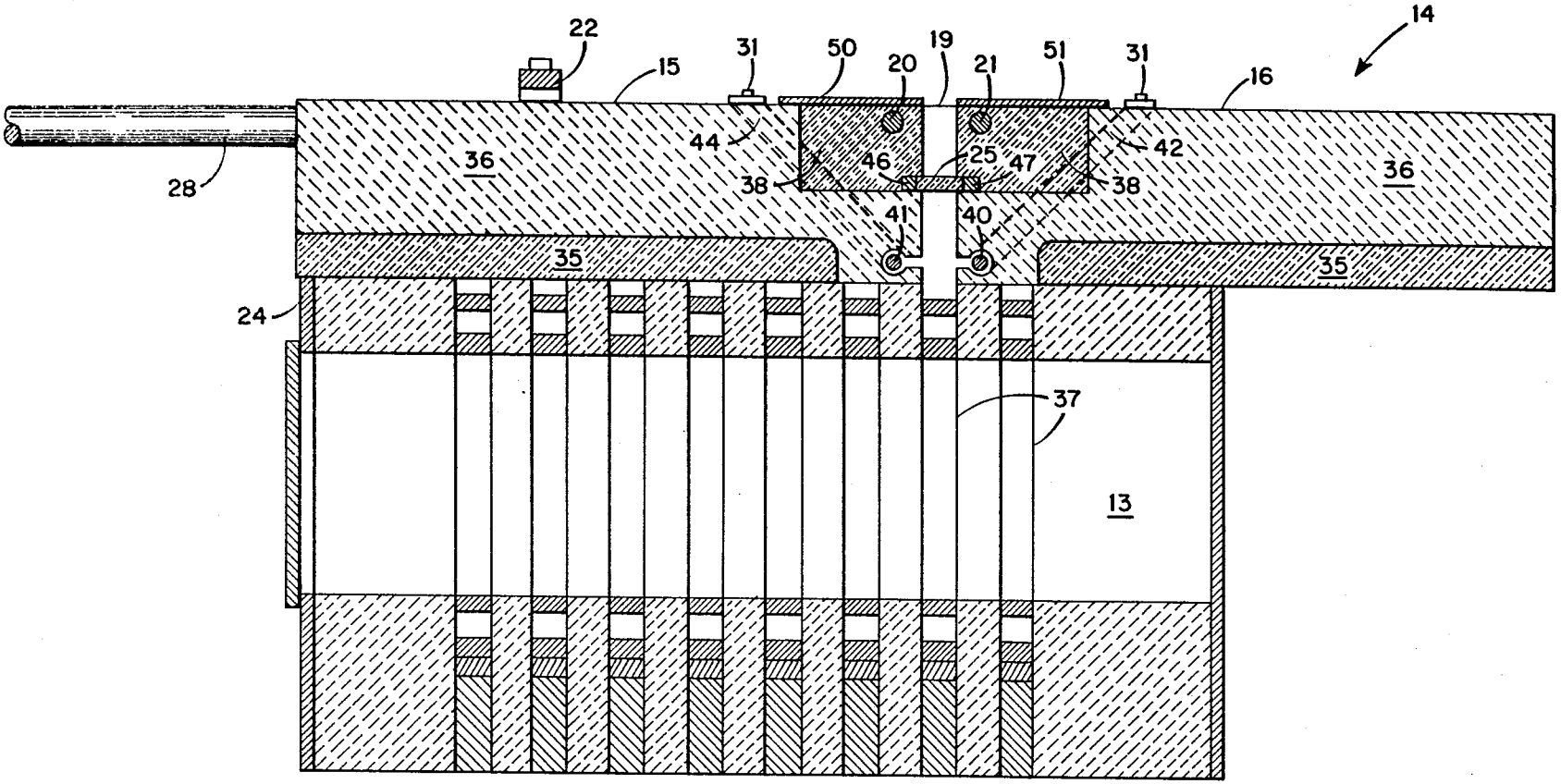
FIG. 2 is a cross-section taken along 2—2 of FIG. 1.

Referring to FIG. 2, viewport assembly 14 is shown in cross-section. Parts 15 and 16 are suitably made of ceramic alumina with fibrous alumina utilized in felted mats for thermal insulation. In the embodiment shown, 1.25 cm. thick felted mat 35 is fused to ceramic body 36 along most of the surface of parts 15 aand 16 adjacent the furnace heating elements 37. Additional felted mats of alumina fiber 38 are provided on either side of slot 19.

Platinum wire coil heaters 40 and 41 are positioned on each side of slot 19 adjacent heating elements 37. Channels 42, 43, 44 and 45 in ceramic body parts 36 contain lead-in wires to heaters 40 and 41. The lead-in wires are suitably of the same material as the coil heaters with a heavier wire. At the outlets of channels 42 through 45, the lead-in wires are connected to cables 60 (FIG. 6) that flex with the movement of viewport assembly 14.

Figure 5:
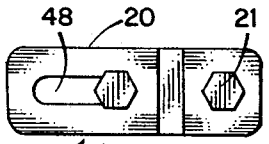
FIG. 5 is a detail view of support bracket 17.

Viewport 25 is a quartz window sitting in recesses 46 and 47 in parts 15 and 16 respectively. The quartz window is suitably cemented into recess 47 leaving it free to move in and out of recess 46. The size of viewport 25 can be varied by moving part 15 away from part 16. The way this is accomplished can be seen in FIG. 5 showing a detail in plan view of bracket 17. Bolt 20 can (when loosened) move back and forth in slot 48 and a corresponding slot (not shown) in bracket 18 moving part 15 relative to part 16. Since the alumina material, through which bolts 20 and 21 pass, is not strong, it preferably reinforced. Metal plates 50 and 51 enclose the portions of parts 15 and 16 respectively, through which bolts 15 and 16 pass. The metal plates are formed and cemented to parts 15 and 16.

Viewport assembly 14 has a cross-section (See FIGS. 3 and 4) in the configuration of two truncated isosceles triangles joined at their truncated points. This arrangement allows viewport 25 to be kept small, while allowing the viewing angle to be varied so as to cover the heated cavity from top to bottom. Viewport 25 is preferably positioned at the narrowest point in order to keep the quartz glass small as well as to minimize the size of recesses 46 and 47. Viewport 25 is typically 2.5 cm×2.5 cm with a quartz window 6 mm thk.

Figure 3:
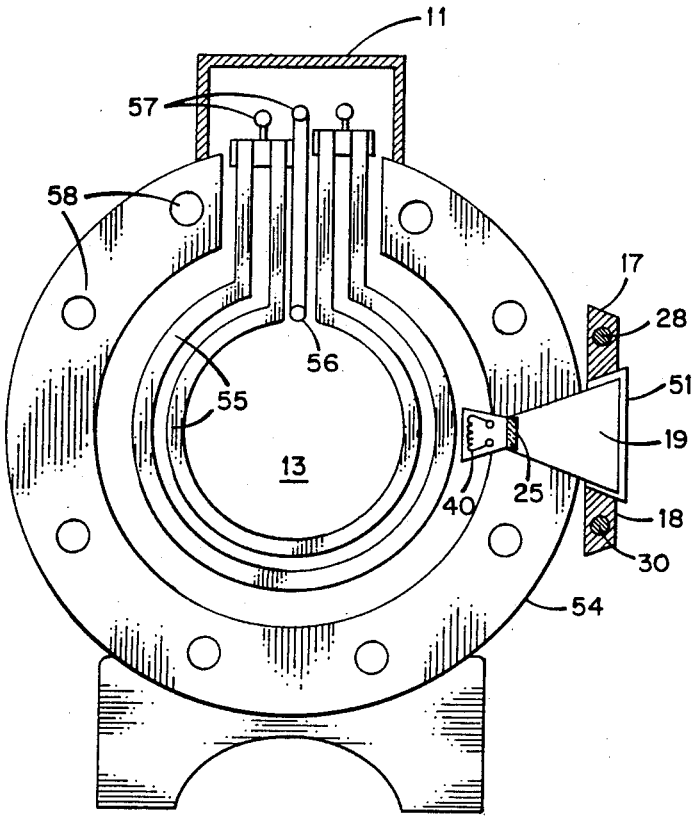
FIG. 3 is a cross-section taken along 3—3 of FIG. 1.
Figure 4:
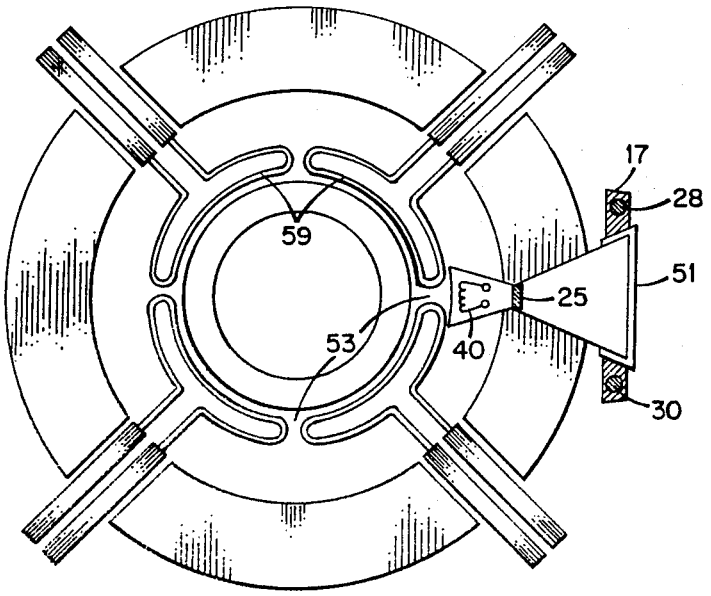
FIG. 4 is a diagrammatic view of a second embodiment of FIG. 3.

FIG. 3 shows a cross-section of furnace 10. Since furnace 10 is assembled in segments, the only pieces cut (cross-hatched) in FIG. 3 are cable enclosure 11, brackets 17 and 18, window 25 and operating rods 28 and 30. Furnace heating elements 55 and temperature sensor 56 have their terminals 57 connected to cables (not shown) in enclosure 11. Apertures 58 in furnace wall 54 are for threaded rods that hold furnace 10 together. It will be seen that the furnace heater configurations of FIG. 3 will block the viewport as the viewport passes by them. The open space between the elements is greater than the thickness of the elements so that the interference is not critical. Where continuous viewing is important or varying the heat around the circumference of the cavity to produce a desired image is required, the heating element configuration of FIG. 4 may be used. The configuration of FIG. 4 uses a plurality of heating elements 59 with separations 53. By lining viewport assembly 14 up with a row of separations 53, continuous viewing can be obtained.

Figure 6:
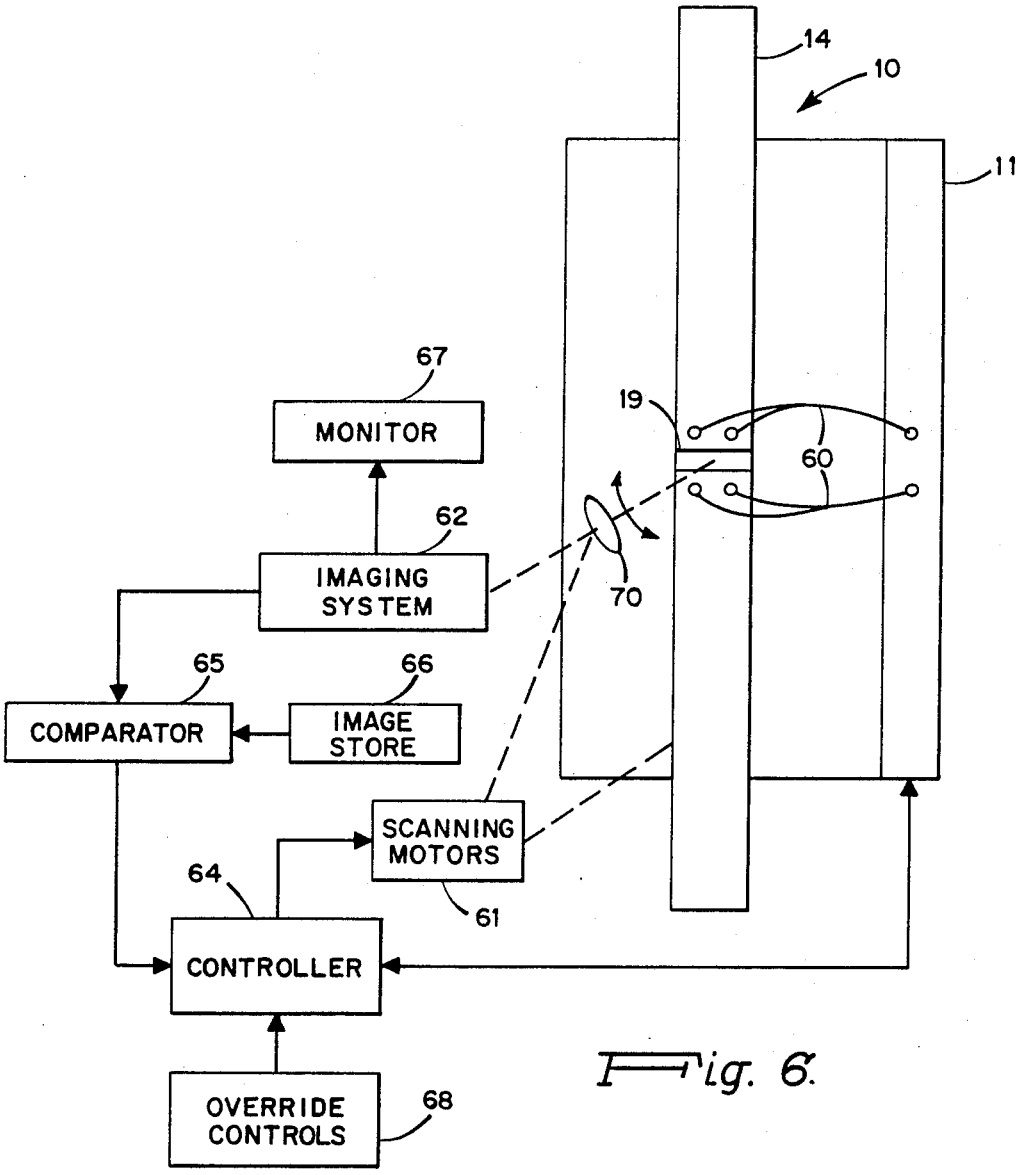
FIG. 6 is a functional diagram of a complete system.

A functional system is shown diagrammatically in FIG. 6. Furnace 10 has viewport assembly 14, motor 61 for driving assembly 14 along aperture 12 and imaging system 62, such as a video camera or infrared imaging device, for viewing the interior of furnace 10 through viewport 25.

Controller 64 has input connections from sensors 56, and comparator 65. Controller 64 has output connections to heaters 55 and motor 61. Comparator 65 has input connections from imaging device 62 and store of sample images 66 and an output connection to controller 64. In addition, device 62 has an output for image monitor 67 and controller 65 has an input from override controls 68. Monitor 67 may be local or remote or both. Override controls 68 also may be local, remote or both.

Varying of the viewing angle for transverse scanning of cavity 13 and a work product in the cavity can be accomplished by physically moving imaging system 62 or by use of a scanning lens system. Lens 65 is depicted as serving this purpose in FIG. 6. Scanning motors 61 operate both longitudinal and transverse scanning.

The system of FIG. 6 is well suited for growing semiconductor crystals such as gallium arsenide. Multicrystalline material is enclosed in refractory glass or quartz with a seed crystal at one end. Next the material is melted starting at the seed end and a transition interface forms. The shape of the transition interface is very critical. The purpose is to end up with a large monocrystal. Any distortion of the transition interface will usually result in extra crystals being formed. Even with the window of the invention it is not usually practical to have a person observing the crystal growth. The process usually takes several days and may take as long as a month.

For crystal growth, the furnace may be positioned vertically so that when the work charge is loaded, the seed crystal is at the bottom. Furnace 10 is heated under control of controller 64 until the temperature sensors indicate the zone adjacent the seed crystal is at the predetermined optimum temperature to start the melt. Video camera 62 is positioned to view this zone and comparator 65 compares the image from camera 62 with sample stored images 66. When the camera image from the furnace makes a match with one of the stored sample images, comparator 65 starts feeding signals to controller 64 that will cause the controller to modify the zone temperature so as to match the optimum sample image. When the transition interface reaches the optimum appearance, controller 64 begins incrementally moving the temperature gradient and viewport assembly 14 together. The temperature gradient is moved by changing the power applied to successive heater elements while the viewport assembly is moved by motor 61 operating, for example, a rack and pinion gearing arrangement (not shown).

While the invention has been described with respect to specific embodiments, variations within the skill of the art are contemplated as falling within the invention. Thus other refractory materials can be used for viewport assembly 14 and other cross-section configurations may be utilized. Other heater wire than platinum can be used as well as further heaters beside the two described. It is further contemplated that the inventive furnace be operated in outer space while being monitored from Earth's surface. Thus it is intended to cover the invention as set forth in the appended claims.

I claim:

1. Furnace apparatus for monocrystal growth comprising:

a. a dynamic gradient furnace having a cavity surrounded by a wall;

b. a longitudinally movable viewing assembly in said wall having a viewport;

c. an imaging system connected to said viewport for obtaining images of a work product in said cavity;

d. an image storage device for storing sample images of a work product;

e. a comparator connected to said imaging system and to said image storage device for comparing sample images with images from said imaging system;

f. a controller connected to said comparator and to temperature sensors and heating elements in said furnace for controlling temperature gradients in said furnace; and, g. a motor connected to said controller and to said viewing assembly for moving said viewing assembly in synchronism with moving temperature gradients, whereby the interface shape of a crystal growing in said furnace may be compared with a desired shape and the furnace controlled to obtain the desired shape.

2. Furnace apparatus for monocrystal growth according to claim 1 wherein said viewing assembly comprises a block of thermally insulating refractory material containing a slot for said viewport and heating elements arranged about said slot so as to compensate for thermal losses by said slot.

3. Furnace apparatus for monocrystal growth according to claim 2 wherein said viewing assembly further comprises means to vary the width of said slot.

4. Furnace apparatus for monocrystal growth according to claim 2 wherein said motor comprises scanning motors for both moving said viewing assembly longitudinally of said cavity and scanning said imaging system transversely of said cavity.

5. A method of controlling a thermally caused transition in a work product in a heated cavity comprising:

(a) viewing a transition cross-section in said work product through a heated opening to said cavity to obtain a viewed image of said work product;

(b) comparing the viewed image with an optimum image;

(c) varying the heat of said cavity to produce a work image equivalent to said optimum image; and, (d) moving a temperature gradient and the heated opening to successive transition cross-sections as optimum transition results are obtained.

* * * * *